US010414478B1

(12) United States Patent
Waisanen et al.

(10) Patent No.: US 10,414,478 B1
(45) Date of Patent: Sep. 17, 2019

(54) MARINE PROPULSION SYSTEMS WITH ACTIVELY TUNABLE SOUND

(71) Applicant: Brunswick Corporation, Mettawa, IL (US)

(72) Inventors: Andrew S. Waisanen, Fond du Lac, WI (US); William P. O'Brien, Eden, WI (US); Steven M. Anschuetz, Fond du Lac, WI (US); Robert R. Osthelder, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/885,261

(22) Filed: Jan. 31, 2018

Related U.S. Application Data

(63) Continuation-in-part of application No. 15/088,656, filed on Apr. 1, 2016, now Pat. No. 9,944,376.

(51) Int. Cl.

| | |
|---|---|
| ***B63H 21/32*** | (2006.01) |
| ***F01N 1/08*** | (2006.01) |
| ***F01N 13/00*** | (2010.01) |
| ***B63H 20/26*** | (2006.01) |
| ***F01N 13/12*** | (2010.01) |
| ***F02B 61/04*** | (2006.01) |

(52) U.S. Cl.
CPC ..... *B63H 20/26* (2013.01); *B63H 21/32* (2013.01); *F01N 13/004* (2013.01); *F01N 13/12* (2013.01); *F02B 61/045* (2013.01); *F01N 2240/20* (2013.01); *F01N 2590/021* (2013.01)

(58) Field of Classification Search
CPC ..... B63H 20/24; B63H 20/245; B63H 20/26; B63H 21/32; B63H 21/34; B63H 21/21; B63H 2021/21; F01N 13/004; F01N 13/12; F01N 2240/20; F01N 2590/021; F02B 61/045
USPC ..... 440/1, 84, 88 R, 88 A, 89 R, 89 J
See application file for complete search history.

(56) References Cited

U.S. PATENT DOCUMENTS

| | | | | |
|---|---|---|---|---|
| 1,824,737 | A | 9/1931 | Johnson | |
| 3,967,446 | A | 7/1976 | Harralson et al. | |
| 4,601,666 | A | 7/1986 | Wood, Jr. | |
| 4,668,199 | A | 5/1987 | Freund et al. | |
| 4,952,182 | A | 8/1990 | Curtis et al. | |
| 5,348,500 | A | 9/1994 | Lassanske | |
| 6,273,771 | B1 | 8/2001 | Buckley et al. | |
| 8,384,528 | B2 * | 2/2013 | McCarthy | H04S 7/00 123/184.21 |
| 8,876,566 | B1 | 11/2014 | Hilbert et al. | |
| 9,051,041 | B2 | 6/2015 | Litjens et al. | |
| 9,404,413 | B2 * | 8/2016 | Schmalzing | B60K 6/48 |

(Continued)

*Primary Examiner* — Daniel V Venne
(74) *Attorney, Agent, or Firm* — Andrus Intellectual Property Law, LLP

(57) ABSTRACT

A marine propulsion system configured to propel a marine vessel in a body of water. The marine propulsion system includes an engine and an exhaust system that conveys exhaust gas from the engine. A controller controls the marine propulsion system and includes a memory module that stores operating modes with corresponding sound profiles for controlling the marine propulsion system. An input device is provided for selecting one of the operating modes for controlling the marine propulsion system. Selecting a first operating mode causes the marine propulsion system to sound different than selecting a second operating mode.

17 Claims, 10 Drawing Sheets

(56) References Cited

U.S. PATENT DOCUMENTS

| | | | | |
|---|---|---|---|---|
| 2014/0055258 | A1* | 2/2014 | Grosse-Budde ..... | B60Q 5/008<br>340/463 |
| 2014/0230435 | A1* | 8/2014 | Schmalzing ..... | B60K 6/48<br>60/608 |

* cited by examiner

| | Bypass Valve Position 124 | | | | | | Engine RPM 161a | | | | | | Fuel/air blend 161d | | | | | |
|---|---|---|---|---|---|---|---|---|---|---|---|---|---|---|---|---|---|---|
| | at Startup | X seconds post-startup | Y seconds post-startup | at Idle Speed | at Z% Throttle | at Wide Open Throttle | at Startup | X seconds post-startup | Y seconds post-startup | at Idle Speed | at Z% Throttle | at Wide Open Throttle | at Startup | X seconds post-startup | Y seconds post-startup | at Idle Speed | at Z% Throttle | at Wide Open Throttle |
| Operating Mode 121a | **Open** | **Open** | **Open** | **Open** | **Open** | **Open** | Std+40% | Std+30% | Std+25% | Std+20% | Std | | Rich | | | | Std | |
| Operating Mode 121b | **Open** | **Open** | **Open** | Intrm. | Intrm. | Intrm. | Std+30% | Std+30% | Std+30% | Std | | | Rich | | | Std | | |
| Operating Mode 121c | **Open** | **Open** | Intrm. | Close | Close | **Open** | Std+30% | | Std | | | | Rich | | Std | | | |
| Operating Mode 121d | **Open** | **Open** | **Open** | **Open** | **Open** | **Open** | Std+40% | Std+30% | Std+25% | Std+20% | Std | | Std | | | | | |
| Operating Mode 121e | **Open** | **Open** | **Open** | Intrm. | Intrm. | Intrm. | Std+30% | Std+30% | Std+30% | Std | | | | | | | | |
| Operating Mode 121f | **Open** | **Open** | Intrm. | Close | Close | **Open** | Std+30% | | Std | | | | | | | | | |
| Operating Mode 121g | **Open** | **Open** | **Open** | **Open** | **Open** | **Open** | Std+40% | Std+30% | Std+25% | Std+20% | Std | | Std | | | | | |
| Operating Mode 121h | **Open** | **Open** | **Open** | Intrm. | Intrm. | Intrm. | Std+30% | Std+30% | Std+30% | Std | | | | | | | | |
| Operating Mode 121i | **Open** | **Open** | Intrm. | Close | Close | **Open** | Std+30% | | Std | | | | | | | | | |
| Operating Mode 121j | **Open** | **Open** | **Open** | **Open** | **Open** | **Open** | Std | | | | | | Std | | | | | |
| Operating Mode 121k | **Open** | **Open** | **Open** | Intrm. | Intrm. | Intrm. | | | | | | | | | | | | |
| Operating Mode 121l | **Open** | **Open** | Intrm. | Close | Close | **Open** | | | | | | | | | | | | |
| Operating Mode 121m | Close | Close | Close | Close | Close | Close | Std | | | | | | Std | | | | | |
| Operating Mode 121n | Close | Close | Close | Close | **Open** | **Open** | | | | | | | | | | | | |
| Operating Mode 121o | Close | Close | Close | Intrm. | Intrm. | Intrm. | | | | | | | | | | | | |
| Operating Mode 121p | Intrm. | Intrm. | Intrm. | Intrm. | Intrm. | Intrm. | Std | | | | | | Rich | | | Std | | |
| Operating Mode 121q | Intrm. | Intrm. | Close | Close | Intrm. | Intrm. | | | | | | | Rich | | Std | | | |
| Operating Mode 121r | Intrm. | Close | Close | Close | Close | Close | | | | | | | Std | | | | | |

FIG. 9

MARINE PROPULSION SYSTEMS WITH ACTIVELY TUNABLE SOUND

CROSS REFERENCE TO RELATED APPLICATION

The present application is a continuation-in-part of U.S. patent application Ser. No. 15/088,656, filed Apr. 1, 2016, which is hereby incorporated herein by reference in entirety.

FIELD

The present disclosure relates to marine propulsion systems, and particularly to actively tunable sound for marine propulsion systems.

BACKGROUND

FIG. 1 depicts a conventional exhaust system A for an outboard marine engine. Dry exhaust gas is conveyed from an internal combustion engine via a vertical exhaust pipe B to a lower gearcase cavity C, wherein the exhaust gas is allowed to expand. When the internal combustion engine is operated at above-idle speeds, most or all of the exhaust gas is discharged via an underwater outlet D, which typically is formed through the gearcase and an associated propeller assembly. When the internal combustion engine is operated at idle speed, the pressure associated with the body of water in which the propeller assembly is situated typically prevents a significant flow of the exhaust gas through the underwater outlet D. Most or all of the exhaust gas tends to take a path of least resistance to atmosphere, which is through an idle relief muffler E and then through an idle relief outlet F. The idle relief outlet F is located above the body of water in which the outboard marine engine is situated.

The following U.S. Patents disclose additional state of the art. These patents are incorporated herein by reference, in entirety:

U.S. Pat. No. 9,051,041 discloses a marine propulsion system for propelling a marine vessel in water. The system comprises an outboard motor that is coupled to a marine vessel. The system comprises an exhaust gas relief outlet that is located above the water when the outboard motor is operated at idle speed. A conduit conveys exhaust gas from the exhaust gas relief outlet to a discharge outlet located on the marine vessel.

U.S. Pat. No. 8,876,566 discloses a marine drive and marine exhaust pipe that include a main exhaust flow chamber and an auxiliary idle relief chamber. The auxiliary idle relief chamber vents exhaust above the surface of the body of water in which the vessel is operating.

U.S. Pat. No. 4,952,182 discloses an exhaust relief system for an outboard motor that includes an exhaust chamber into which exhaust is discharged from the engine. A first passage in communication with the exhaust chamber provides contraction of the exhaust as the exhaust passes rearwardly from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system, along with the repeated expansion and contraction of the exhaust as it flows to atmosphere, provides a muffling effect at idle operation.

U.S. Pat. No. 4,668,199 discloses an exhaust system for an outboard motor that includes a main exhaust passageway extending through a partially water-filled chamber in the drive shaft housing. An inlet idle relief passage connects the top of the chamber with the main exhaust passageway and an outlet passage connects the top of the chamber with the atmosphere.

U.S. Pat. No. 3,967,446 discloses a tuned exhaust gas relief system for marine propulsion systems, for example an outboard motor, that includes a lower drive shaft housing coupled to a two stroke engine by a pair of intermediate stacked exhaust extension plates. The housing directs the exhaust gas downwardly to a through-the-hub exhaust propeller for exit there through. With the unit in reverse or idling, exhaust gases are trapped within the housing. A pair of tuned exhaust relief passageways may be formed by cavities in the mating faces of the two extension plates with a pair of inlet openings in the lower wall of the bottom plate. A baffle member may overlie the inlet openings. The passageways define constant cross-sectional area channels which terminate in exhaust openings in the rear wall of the drive shaft housing.

U.S. Pat. No. 6,273,771 discloses a control system for a marine vessel that incorporates a marine propulsion system that can be attached to the marine vessel and connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus. The controller is connected in signal communication with each of the plurality of devices on the communication bus. The input and output devices can each transmit messages to the serial communication bus for receipt by other devices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a marine propulsion system is configured to propel a marine vessel in a body of water. The marine propulsion system includes an engine and an exhaust system that conveys exhaust gas from the engine. A controller controls the marine propulsion system and comprises a memory module that stores operating modes with corresponding sound profiles for controlling the marine propulsion system. An input device is provided for selecting one of the operating modes for controlling the marine propulsion system. Selecting a first operating mode causes the marine propulsion system to sound different than selecting a second operating mode.

Other examples relate to methods of making a marine propulsion system configured to propel a marine vessel in a body of water. One such method includes coupling an exhaust system to an engine, where the exhaust system conveys exhaust gas from the engine. The method includes operatively connecting a controller to the marine propulsion system, the controller controlling the marine propulsion device and also comprising a memory module. The method further includes storing in the memory module operating modes with corresponding sound profiles for controlling the marine propulsion system and operatively connecting to the controller an input device configured for selecting one of the operating modes for controlling the marine propulsion system. Selecting a first operating mode causes the marine propulsion system to sound different than selecting a second operating mode.

Another example relate to a marine propulsion device for propelling a marine vessel in a body of water that includes an engine and an exhaust system that conveys exhaust gas from the engine. A controller controls the marine propulsion device according to alternate first and second operational modes stored in a memory module and the marine propulsion device is controllable to perform a same set of functions in either of the first and second operational modes. The first and second operational modes cause the marine propulsion device to produce first and second sound profiles that are different from each other. An operator input device facilitates operator selection between the first and second operational modes to thereby produce the selected one of the first and second sound profiles.

BRIEF DESCRIPTION OF THE DRAWINGS

The present disclosure is described with reference to the following drawing FIGURES. The same numbers are used throughout the FIGURES to reference like features and like components.

FIG. 9 depicts exemplary operating modes for controlling the marine propulsion system according to the present disclosure.

DETAILED DESCRIPTION OF THE DRAWINGS

Through research and development, the inventors have determined that noise requirements and expectations for a given outboard marine engine can vary depending upon the operator application. For example, performance boaters may desire a louder, more aggressive sound quality than recreational boaters or an off-shore fisherman. However, satisfying these differing product noise requirements or expectations for a given marine propulsion system presently requires extensive modification and is accomplished exclusively through changes to hardware. Specifically, existing solutions are limited to changes in hardware configuration with a single engine calibration used for controlling this hardware. Additional information regarding control systems for marine vessels known in the art is provided in U.S. Pat. No. 6,273,771, which is incorporated herein by reference.

Figure 1:
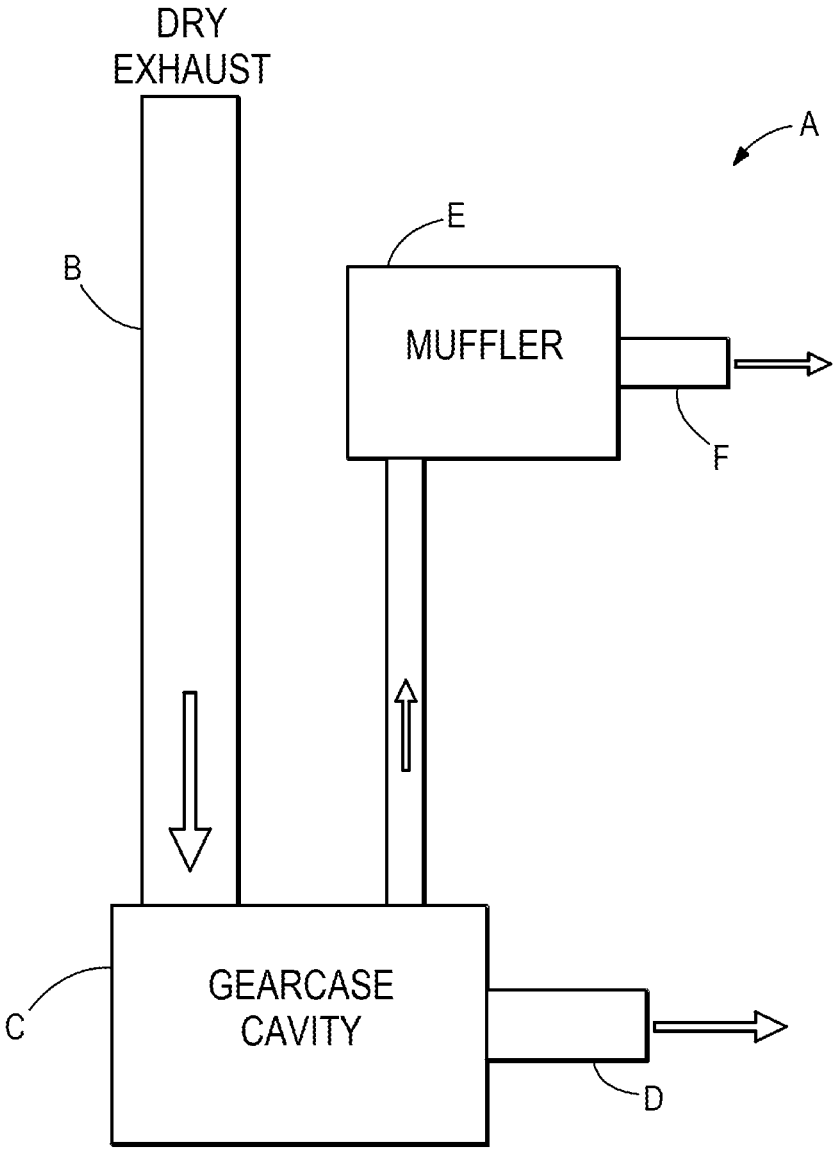
FIG. 1 PRIOR ART
FIG. 1 is a schematic view of a prior art exhaust system for an outboard marine engine.

Referring to FIG. 1, which is described herein above, the present inventors have determined that conventional exhaust systems for outboard marine engines do not adequately allow an operator to actively tune the exhaust system. More specifically, the present inventors have determined that it would be desirable to provide actively tunable exhaust systems for outboard marine engines, wherein the operator is given the ability to select between a variety of exhaust sounds and/or performance configurations. The present disclosure is a result of the inventors' research and experimentation directed towards providing the operator of an outboard marine engine with the ability to select a particular sound quality of the exhaust system.

Figure 3:
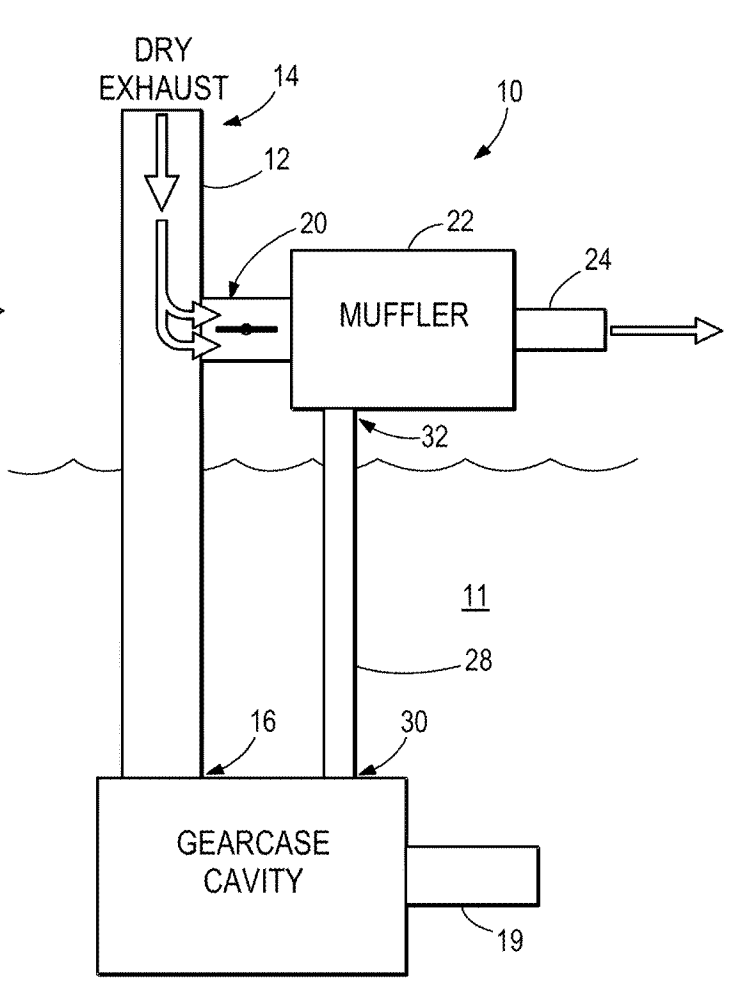
FIG. 3 is another schematic view of the exhaust system shown in FIG. 2.
Figure 2:
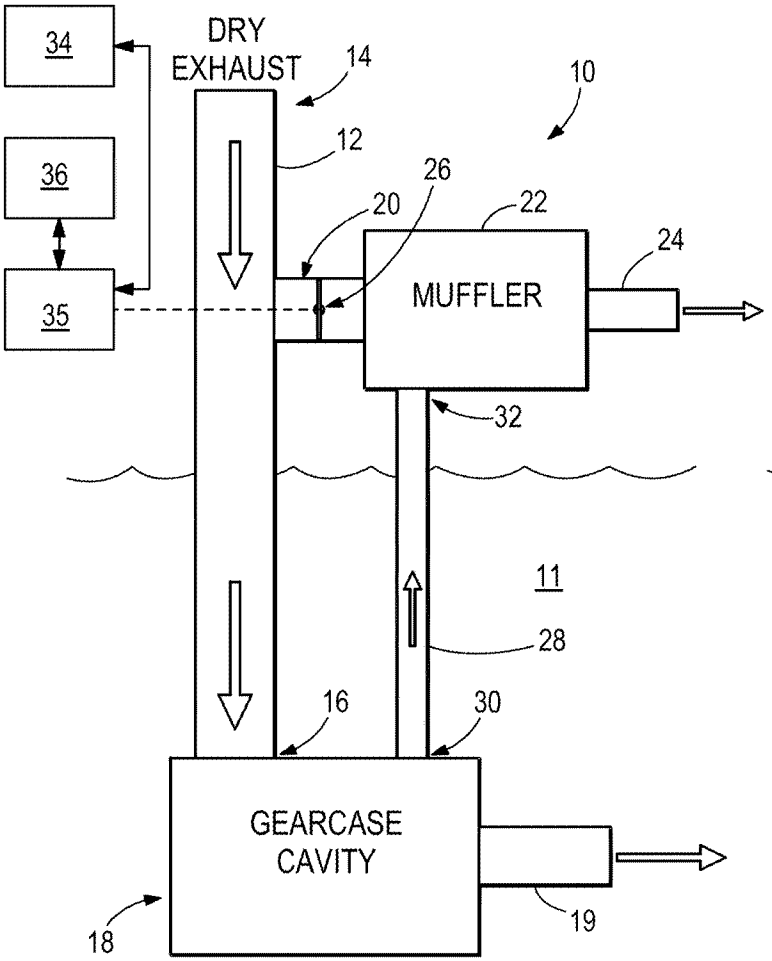
FIG. 2 is a schematic view of a first exemplary exhaust system for an outboard marine engine according to the present disclosure.

FIGS. 2 and 3 depict a first example of the present disclosure. FIGS. 4-7 depict a second example of the present disclosure.

Referring first to FIGS. 2 and 3, an exemplary exhaust system 10 is schematically depicted for use with an outboard marine engine. As is conventional, the outboard marine engine has an internal combustion engine (not shown) and is configured to propel a marine vessel in a body of water according to known principles. FIGS. 2 and 3 are schematic in nature and do not depict the internal combustion engine; however internal combustion engines are well known in the art, examples of which being described in the above-referenced U.S. Patents. The exhaust system 10 includes a primary exhaust conduit 12 having an upstream end 14 that is configured to receive hot, dry exhaust gas from the noted internal combustion engine and a downstream end 16 that is configured to discharge the exhaust gas to the body of water via a gearcase cavity 18 of the outboard marine engine. The manner in which the exhaust gas is discharged from the gearcase cavity 18 can vary. In certain examples, the exhaust gas is discharged via a propeller housing outlet 19 that is located in the body of water when the outboard marine engine is in use. This is a conventional arrangement for discharging the exhaust gas from an outboard motor and thus the propeller housing outlet 19 is schematically shown and is not further described herein.

An intermediate exhaust conduit 20 is coupled to the primary exhaust conduit 12 between the upstream end 14 and the downstream end 16. The intermediate exhaust conduit 20 receives the exhaust gas from the primary exhaust conduit 12. Optionally, a muffler 22 (sometimes referred to in the art as an "idle relief muffler") receives the exhaust gas from the intermediate exhaust conduit 20 and discharges the exhaust gas to an idle relief outlet 24, which typically is formed through a cowling of the outboard marine engine. In other examples, the intermediate exhaust conduit 20 discharges the exhaust gas to the idle relief outlet 24 without passing through a muffler. In these examples, the intermediate exhaust conduit 20 and/or idle relief outlet 24 can form a tuned outlet duct that exits the cowl of the outboard marine engine separately or through the idle relief outlet 24. The idle relief outlet 24 is configured to discharge the exhaust gas to atmosphere. More specifically, the idle relief outlet 24 is configured to be located above the body of water in which the outboard marine engine is operating, at least when the outboard marine engine is operated at an idle speed.

According to the present disclosure, a bypass valve 26 is coupled to and/or located in the intermediate exhaust conduit 20 between the primary exhaust conduit 12 and the idle relief outlet 24. The type of bypass valve 26 can vary and in certain examples can be a conventional mechanically-controlled valve and in other examples can be a conventional electrically-controlled valve. The bypass valve 26 is positionable into an open position, shown in FIG. 3, wherein the exhaust gas is permitted to flow through the intermediate exhaust conduit 20 from the primary exhaust conduit 12 to the muffler 22 and idle relief outlet 24. Thus, in the open position, the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally via the muffler 22. The bypass valve 26 is alternately positionable into a closed position, shown in FIG. 2, wherein the exhaust gas is not permitted to flow through the intermediate exhaust conduit 20 from the primary exhaust conduit 12, and thus is not allowed to bypass the downstream end 16 of the primary exhaust conduit 12 and gearcase cavity 18. Instead the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. The secondary exhaust conduit 28 has an upstream end 30 that is configured to receive the exhaust gas from the gearcase cavity 18 and a downstream end 32 that is configured to discharge the exhaust gas to the muffler 22, for subsequent discharge via the idle relief outlet 24.

In some examples, the bypass valve 26 can be positionable into one or more intermediate position(s) wherein, as compared to the noted open position, a reduced amount of the exhaust gas is permitted to bypass the downstream end 16 of the primary exhaust conduit 12 and gearcase cavity 18. In other words, when the bypass valve 26 is in the intermediate position(s), some of the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally the muffler 22. The remainder of the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. This example provides the operator with additional active tunability of the sound emanating from the exhaust system 10.

In some examples, the exhaust system 10 can include an operator input device 34 that is mechanically and/or electrically and/or otherwise communicatively coupled to and configured to control the bypass valve 26. The operator input device 34 can be configured such that, via the operator input device 34, an operator can have the ability to selectively position the bypass valve 26 into and out of the open and closed positions, and optionally the intermediate position(s). The type and configuration of the operator input device 34 can vary and the manner in which the operator input device 34 is connected to the bypass valve 26 can vary. In certain non-limiting examples, the operator input device 34 can include one or more mechanical levers, and/or computer keypads, and/or touch screens and/or the like. The operator input device 34 can be configured to directly communicate with and control the position of the operator input device 34 via for example a mechanical, or electronically wired or wireless communication link, an example of which is schematically shown in the drawings. In other examples, the operator input device 34 can be configured to communicate an operator input to the operator input device 34 to a computer controller 35, such as an engine control unit (ECU) that is configured to electronically control the bypass valve 26.

The noted controller 35 can be programmable and include a processor and a memory, which are also discussed in further detail below. The controller 35 can be located anywhere in the system and/or located remote from the system and can communicate with various components of the marine vessel via wired and/or wireless links. In certain examples, the controller 35 is an engine control unit (ECU) that is also configured to control the internal combustion engine and/or other components of the outboard marine engine. Although FIG. 2 schematically shows one controller 35, the system can include more than one controller 35. For example, the system can have a controller 35 located at or near a helm of the marine vessel and can also have one or more controllers located at or near the outboard marine device. Portions of the methods disclosed herein below can be carried out by a single controller or by several separate controllers. Each controller can have one or more control sections or control units.

One having ordinary skill in the art will recognize that the controller 35 can have many different forms and is not limited to the example that is shown and described. In some examples, the controller 35 may include a computing system that includes a processing system, storage system, software, and input/output (I/O) interfaces for communicating with devices such as those shown in FIGS. 2 and 3. As provided above, further information regarding control systems for marine vessels is also available in U.S. Pat. No. 6,273,771.

The processing system loads and executes software from the storage system. When executed by the computing system, software directs the processing system to operate as described herein below in further detail to execute the methods described herein. The computing system may include one or many application modules and one or more processors, which may be communicatively connected. The processing system can comprise a microprocessor and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

Optionally, the exhaust system 10 can include an indicator device 36 that is configured to indicate to the operator a current position of the bypass valve 26. The operator input device 34 and/or indicator device 36 can be located remotely from the outboard marine engine, for example at the helm of the marine vessel, or even remotely from the marine vessel. The type of indicator device 36 can vary. In certain non-limiting examples, the indicator device 36 can include a video or touch screen, and/or flashing lights, and/or the like. The indicator device 36 can be electronically controlled by the controller 35 to indicate to the operator the current position of the bypass valve 26.

Via the operator input device 34, the exemplary system shown in FIGS. 2 and 3 advantageously provides the operator of the outboard marine engine with the ability to actively control the quality and characteristics of exhaust sound emanating from the exhaust system 10. This capability can provide significant advantages in certain settings. For example performance and/or bass boaters can obtain a louder, more aggressive sound quality. Off-shore fisherman or recreational boaters can obtain a quieter, less aggressive sound quality.

Effectively, these examples transform a traditional passively-controlled exhaust system (A) for an outboard marine engine into a multi-stage exhaust system 10 that can be actively controlled by the operator. The operator can select between through-cowl and through-prop exhaust modes, rather than relying on a passive pressure differential. The exhaust gas can be routed through a muffler 22 prior to exiting the idle relief outlet 24, creating an opportunity to refine the audible exhaust note. This allows the operator to select the sound quality "character" of their choosing, advantageously eliminating a need to provide alternative hardware options to address different market demands with a common engine architecture. In addition, the purchaser of the outboard marine engine no longer needs to choose between one type of sound quality and another, but rather has the ability to change back and forth depending on their wants and needs. These examples thus provide an opportunity to showcase noise-vibration-harshness characteristics that are both quiet and powerful.

An additional, initially unforeseen advantage of these examples is their potential to increase horsepower through reduced exhaust gas backpressure as well as reduce risk for water reversion to the internal combustion engine by adding an exhaust circuit at a higher elevation (i.e. above the surface of the body of water 11) on the primary exhaust conduit 12.

Figure 5:
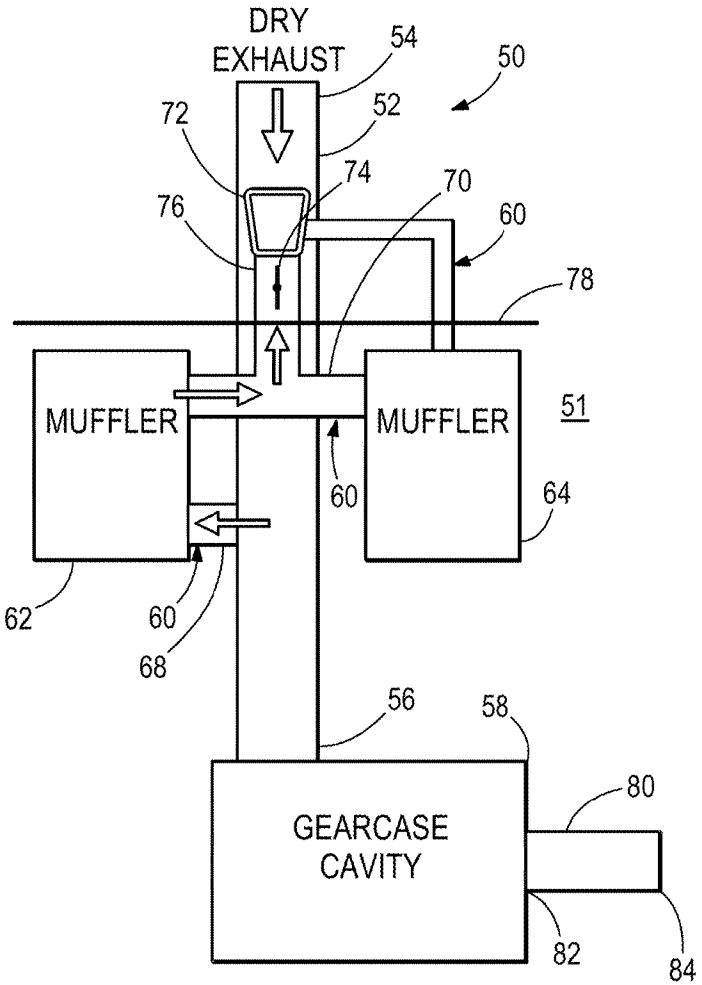
FIG. 5 is another schematic view of the exhaust system shown in FIG. 4.
Figure 4:
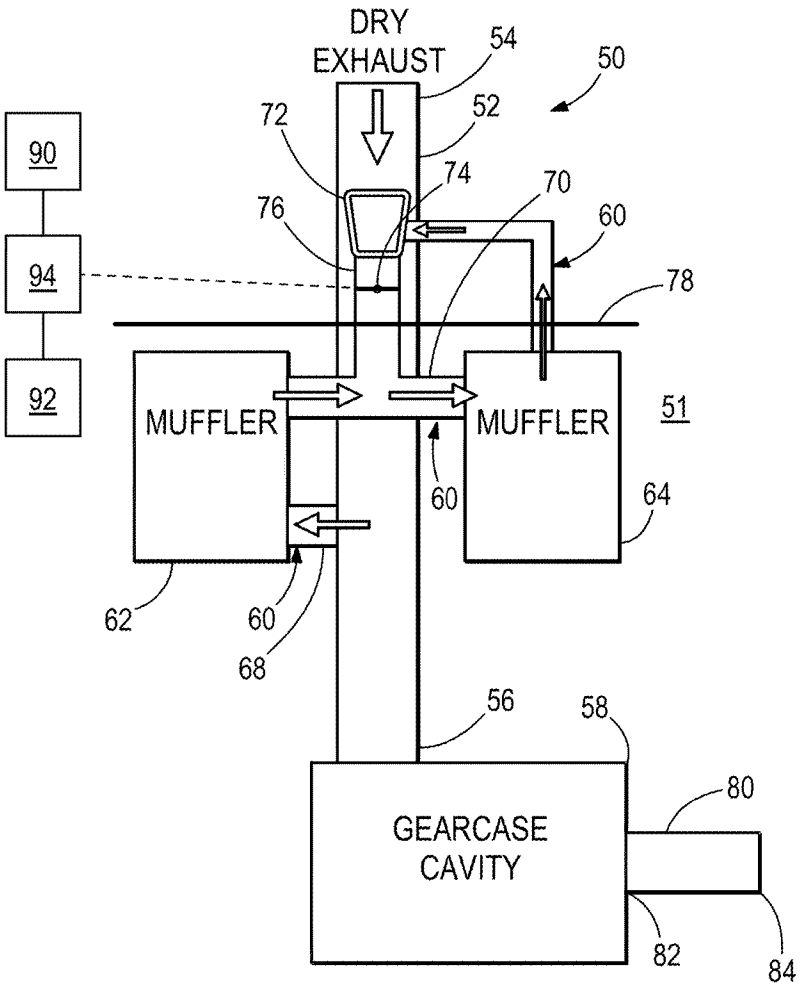
FIG. 4 is a schematic view of a second exemplary exhaust system for an outboard marine engine according to the present disclosure.
Figure 6:
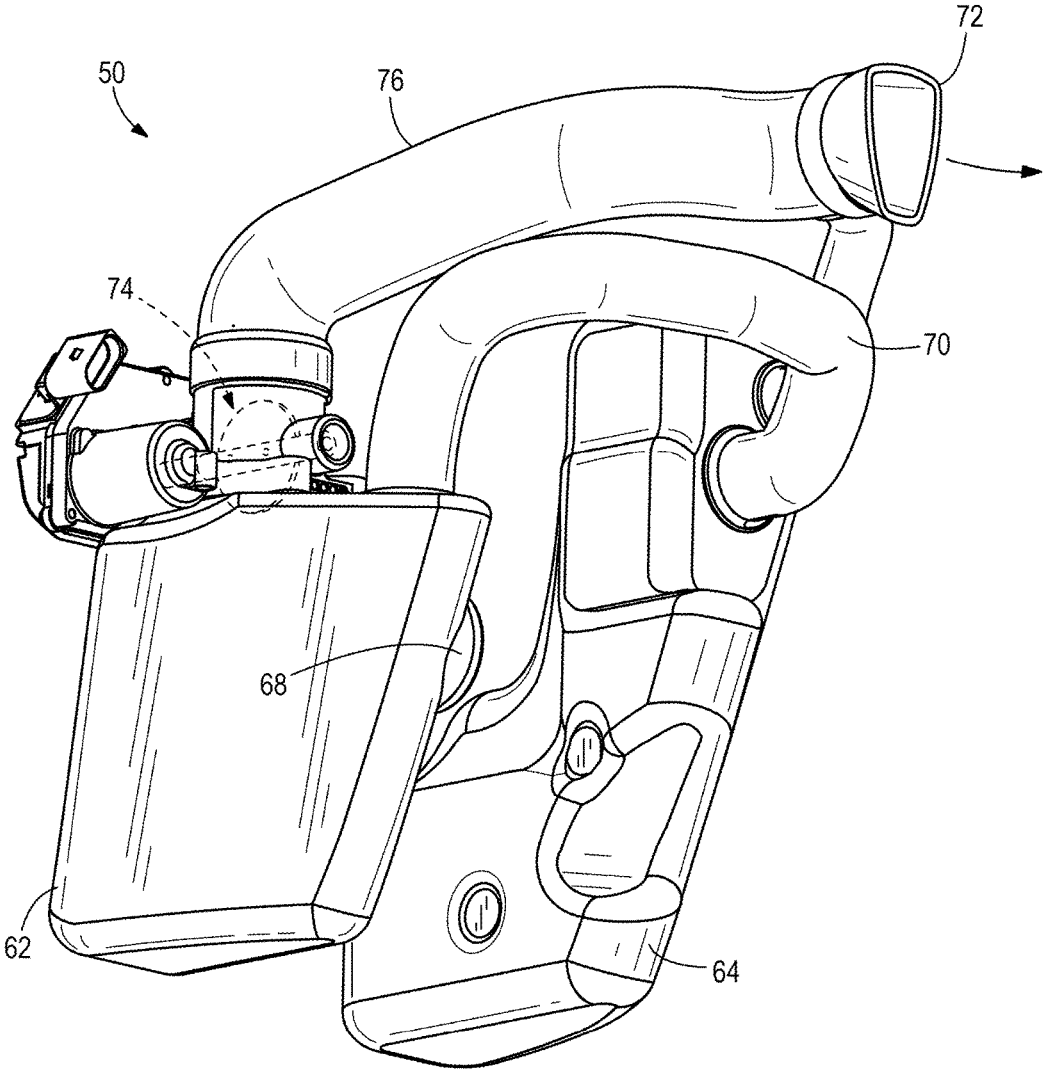
FIGS. 6 and 7 are front and rear perspective views of an exemplary exhaust system in accordance with what is schematically shown in FIGS. 4 and 5.
Figure 7:
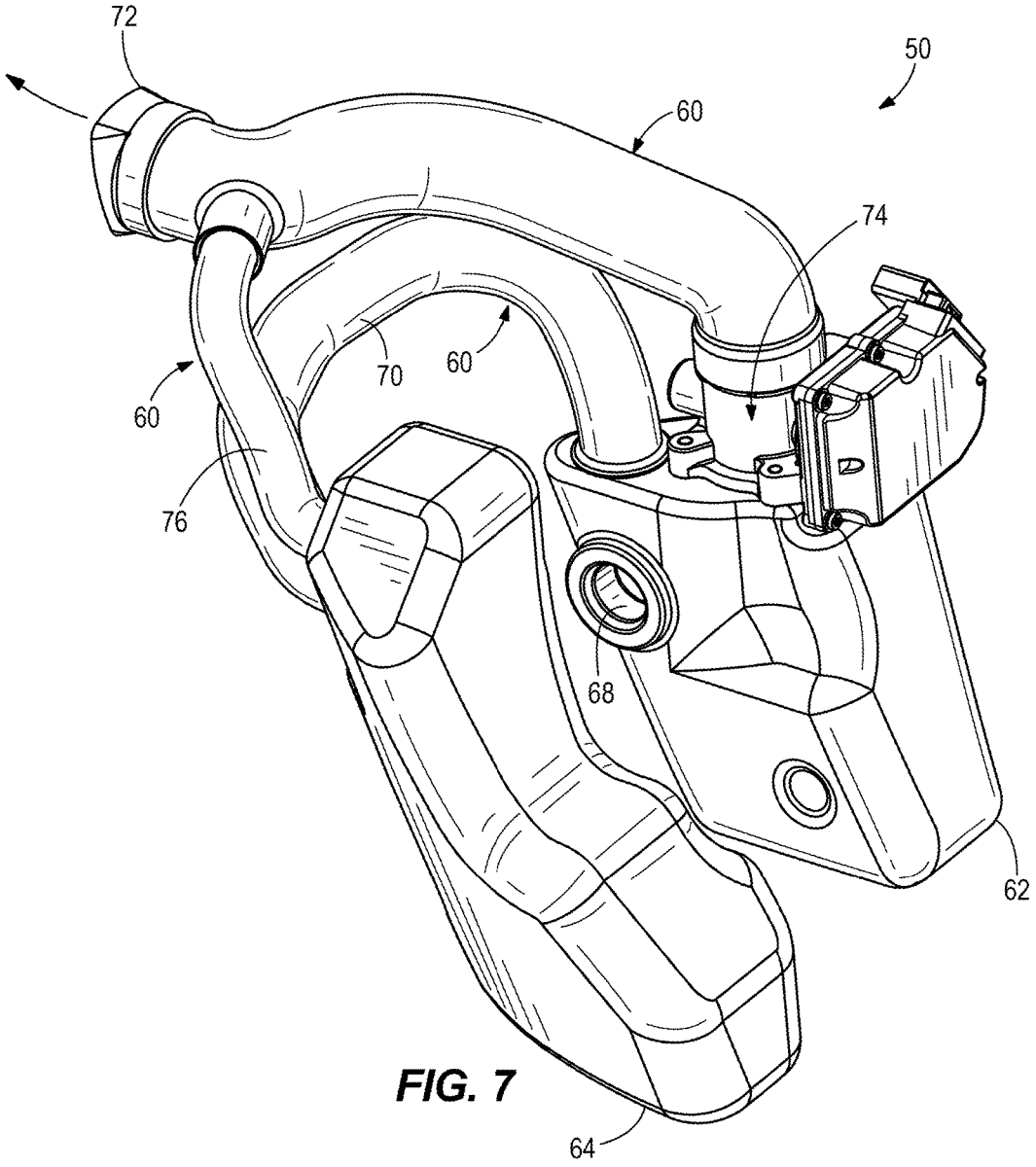

FIGS. 4-7 depict another example of an exhaust system 50 for an outboard marine engine having an internal combustion engine and configured to propel a marine vessel in a body of water 51. FIGS. 4 and 5 are schematic views and FIGS. 6 and 7 are perspective views of certain components.

The exemplary exhaust system 50 includes a primary exhaust conduit 52 having an upstream end 54 that is configured to receive exhaust gas from the noted internal combustion engine and a downstream end 56 that is configured to discharge the exhaust gas to a surrounding body of water 51 via a gearcase cavity 58 and via a secondary exhaust conduit 80. The secondary exhaust conduit 80 has an upstream end 82 configured to receive the exhaust gas from the gearcase cavity 58 and a downstream end 84 configured to discharge the exhaust gas to the body of water 51.

An intermediate exhaust conduit 60 is coupled to the primary exhaust conduit 52 between the upstream end 54 and downstream end 56 and is configured to receive the exhaust gas from the primary exhaust conduit 52. A primary muffler 62 receives the exhaust gas from the intermediate exhaust conduit 60. A secondary muffler 64 receives the exhaust gas from the primary muffler 62 via the intermediate exhaust conduit 60. The intermediate exhaust conduit 60 has an upstream end 68 that receives the exhaust gas from the primary muffler 62 and a first downstream outlet 70 that discharges the exhaust gas to the secondary muffler 64.

The exhaust system 50 also includes an idle relief outlet 72 that discharges the exhaust gas from the secondary muffler 64 to atmosphere. The idle relief outlet 72 is configured to be located above the body of water in which the outboard marine engine is operated, at least when the outboard marine engine is operated at an idle speed.

A bypass valve 74 is coupled to and/or positioned in the intermediate exhaust conduit 60 and is positionable into an open position, shown in FIG. 5, wherein the exhaust gas is permitted to bypass the secondary muffler 64 and flow from the primary muffler 62 to the idle relief outlet 72. The intermediate exhaust conduit 60 has a second downstream end 76 that discharges the exhaust gas to the idle relief outlet 72 when the bypass valve 74 is in the noted open position. The bypass valve 74 is further positionable into a closed position, shown in FIG. 4, wherein the exhaust gas is not permitted to bypass the secondary muffler 64 via the second downstream end 76. Instead the exhaust gas flows from the primary muffler 62 to the idle relief outlet 72 via the first downstream outlet 70 and secondary muffler 64.

In certain examples, the bypass valve 74 is also positionable into one or more intermediate position(s) wherein, compared to the open position, at an idle speed of the internal combustion engine, a reduced amount of exhaust gas is permitted to bypass the secondary muffler 64 and flow from the primary muffler 62 to the idle relief outlet 72. In other words, at an idle speed of the internal combustion engine, in the intermediate position(s) a portion of the exhaust gas is permitted to bypass the secondary muffler 64 and a portion of the exhaust gas is forced to flow through the secondary muffler 64. Both portions are discharged from the outboard marine engine via the idle relief outlet 72. In certain examples, the bypass valve 74 is located at the second downstream end 76 of the intermediate exhaust conduit 60, at a location that is on an opposite side of an adapter plate 78 of the outboard marine engine relative to the primary and secondary mufflers 62, 64.

When the bypass valve 74 is in the closed position the exhaust system 50 forms a dual muffler circuit and when the bypass valve 74 is in the open position, the exhaust system includes a single muffler circuit. The exhaust system 50 operates in a "quiet mode" when the bypass valve 74 is in the closed position and the exhaust gas is routed through the more restrictive, increased-transmission-loss, dual muffler circuit. The exhaust system 50 operates in a relatively louder "sport mode", when the bypass valve 74 is in the open position and the exhaust gas is routed through the less restrictive, decreased-transmission-loss, single muffler circuit.

In certain examples, the exhaust system 50 includes an operator input device 90, an indicator device 92 and/or a computer controller 94, which can be constructed and function in the same manner as the operator input device 34, indicator device 36, and computer controller 35 described herein above with respect to FIGS. 2-3.

An advantage of the example shown in FIGS. 4-7 is that the bypass valve 74 is physically removed from potentially hot, dry exhaust gas in the primary exhaust conduit 52, which could otherwise potentially degrade the operational life of the valve. Instead, the bypass valve 74 is configured to control flow of cooled, wet exhaust gas typically found an idle relief circuit. Also, the bypass valve 74 (and/or a separate actuator controlling the position of the bypass valve 74) can advantageously be located under the noted cowling for the internal combustion engine, above the adapter plate 78 and in-line with the idle relief outlet. This lessens the potential damaging or degrading effects of exposure of the bypass valve 74 (and/or the separate actuator, when applicable) to the surrounding elements, such as water.

Figure 8A:
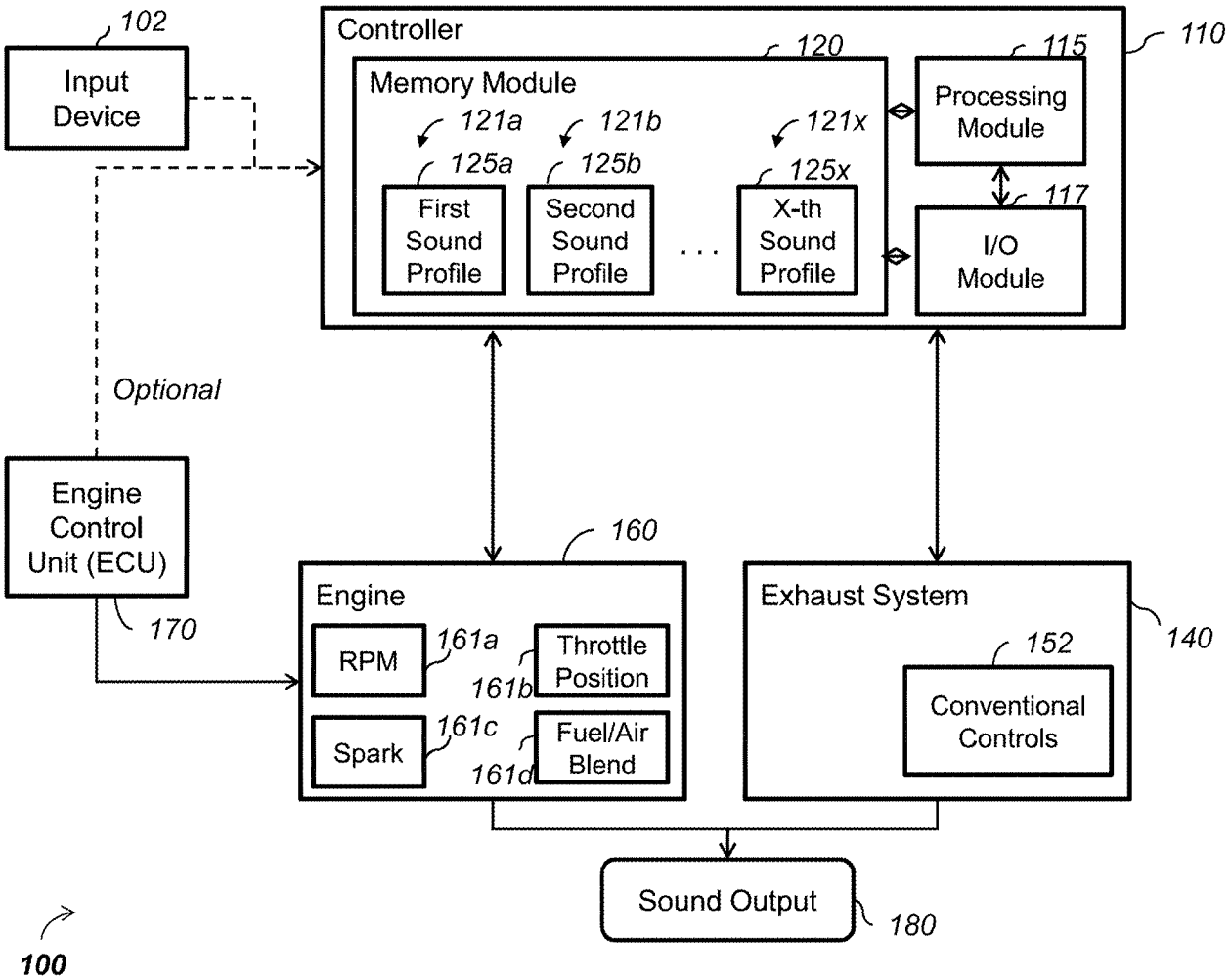
FIGS. 8A-8B are schematic views of first and second exemplary marine propulsion systems configured according to the present disclosure.
Figure 8B:
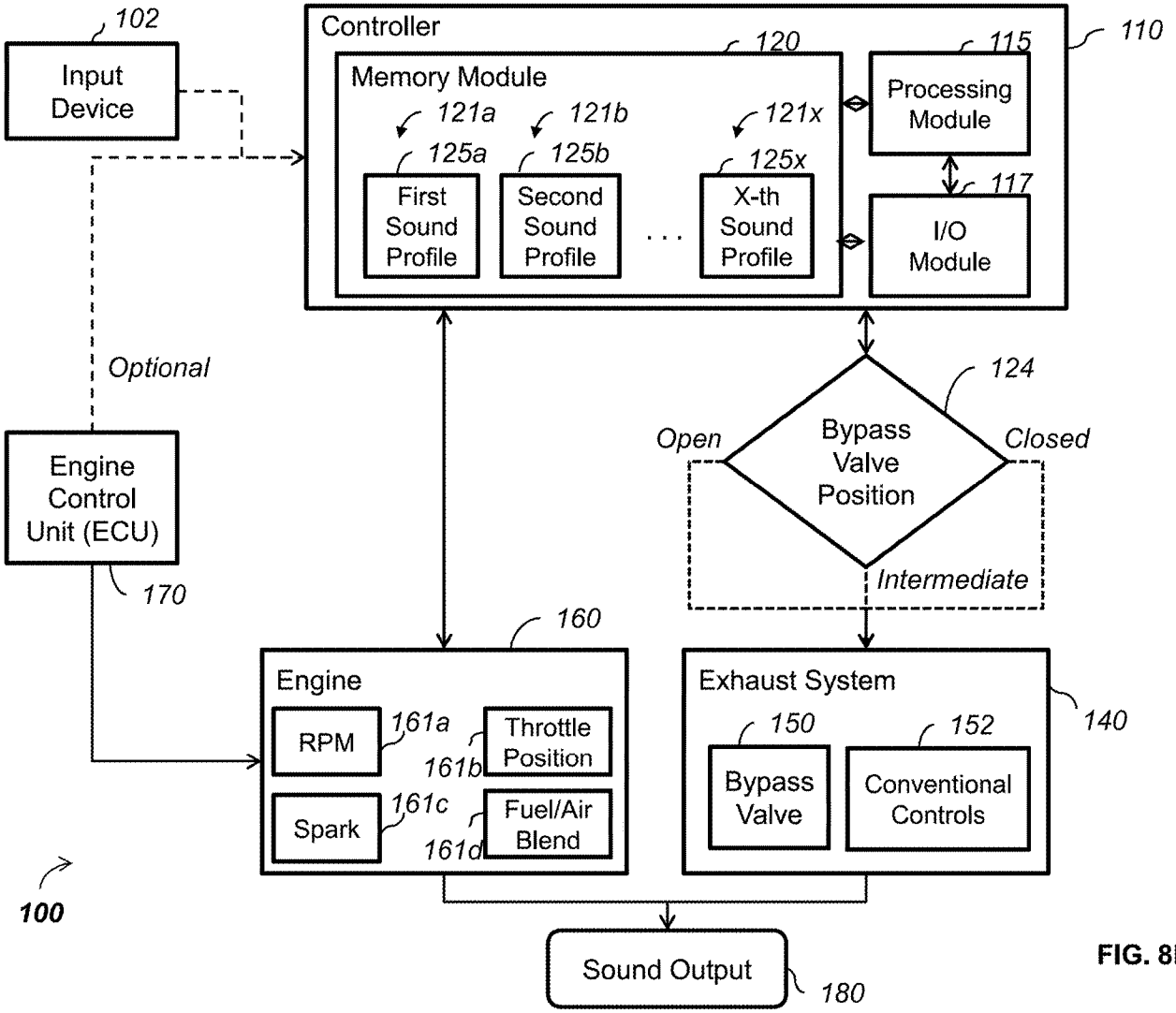

Further aspects of the present disclosure relate to actively controlling or tuning the sound output generated by a marine propulsion system that is configured to propel a marine vessel in a body of water, such as those shown in FIGS. 1-7. FIGS. 8A-B depict exemplary marine propulsion systems 100 according to the present disclosure, which include an engine 160 coupled to an exhaust system 140 that conveys exhaust gas from the engine 160 in the manner previously described. A controller 110 controls the marine propulsion system 100.

In particular, FIG. 8A depicts a schematic view of one embodiment of the present disclosure for controlling a marine propulsion system 100, such as one having a conventional exhaust system like that shown in FIG. 1. A controller 110 includes a processing module 115, an Input/Output (I/O) module 117, and a memory module 120 that stores operating modes 121*a-x*. Additional information and examples regarding the controller 110, the processing module 115, the I/O module 117, and memory module 120, was described above with respect to similar controller 35 and related elements. One of ordinary skill in the art will recognize that these elements may be interconnected in a variety of manners, including wired and wireless connections therebetween.

The operating modes 121*a-x* provide for corresponding sound profiles 125*a-x* for controlling the marine propulsion system 100. As will become apparent through the discussion to follow, the sound profiles 125*a-x* generally correspond to the sound output 180 (for example, in decibels) produced by the marine propulsion system 100 over time as it is controlled by the controller 110 in accordance with one of the operating modes 121*a-x*. For example, controlling the marine propulsion system 100 according to operating mode 121*a* produces a sound output 180 that resembles or follows the pattern of the corresponding sound profile 125*a*. Some of the sound profiles 125*a-x* provide for a sound output 180 that begins at startup more "aggressively" than a conventional marine propulsion system (i.e., louder), but that quickly transitions to a sound output 180 consistent with conventional marine propulsion systems. Likewise, other sound profiles 125*a-x* provide for a sound output 180 that is quieter than a conventional marine propulsion system at startup, for example. In this regard, the present systems and methods provide for active tuning of the sound output 180 produced by a marine propulsion system 100 through selection of operating modes 121*a-x* providing corresponding sound profiles 125*a-x*.

It should be recognized that selecting between operating modes 121*a-x* indicates also selecting between the sound profiles 125*a-x* (and visa versa). As such, the present disclosure often refers to selecting among either the operating modes 121*a-x* or the sound profiles 125*a-x*, without expressively identifying both.

The marine propulsion systems 100 of FIGS. 8A-B further include an input device 102 for selecting one of the operating modes 121*a-x* for controlling the marine propulsion system 100. As discussed above, selecting a first operating mode 121*a* causes the marine propulsion system 100 to sound different than when selecting a second operating mode 121*b*, etc., since each has a different, corresponding sound profile 125*a-b*. The input device 102 may be a keypad, switch, gauge, or other mechanisms known in the art for making selections.

As shown in FIG. 8A, the controller 110 is operatively connected to the exhaust system 140 and also to the engine 160. The controller 110 controls the marine propulsion system 100 to produce different sound outputs 180 based on controls of the exhaust system 140 and/or the engine 160 in accordance with the selected operating mode 121*a-x*. For example, the controller 110 may control the engine 160 with regard to engine RPM 161*a* (for example, a target or maximum engine RPM), a throttle position 161*b*, a level or timing of spark 161*c* delivered by the spark plugs, a fuel/air blend 161*d*, or other control parameters for operating the engine 160. Likewise, the controller 110 may control the exhaust system 140 with regard to any conventional controls 152 or others contained therein. Specific examples of controls for the exhaust system 140 are provided below.

While the present disclosure provides systems and methods for actively tuning the sound output 180 generated by a marine propulsion device 100 through control of the engine 160 and/or the exhaust system 140, specific details regarding the interconnectivity and signal communication among devices to effectuate such control are provided in U.S. Pat. No. 6,273,771, along with control arrangements known in the art.

In certain embodiments, the operating modes 121*a-x* include startup characteristics for controlling the marine propulsion system 100 when the engine 160 starts, as well as idle characteristics for controlling the marine propulsion system 100 when the engine 160 is controlled at an idle speed. Exemplary functions that are controllable by the controller 110 according to operating modes 121*a-x* when the engine 160 starts or is controlled at an idle speed are shown in FIG. 9. In certain embodiments, at least one of the startup characteristics or the idle characteristics is different between a first operating mode 121*a* and a second operating mode 121*b*. In this manner, an operator can selectively tune the sound output 180 of the marine propulsion system 100 at such states of operation.

In certain embodiments and in certain operating modes 121*a-x*, control by the controller 110 changes only with respect to the engine 160 or with respect to the exhaust system 140 with the other remaining static. Moreover, in certain embodiments, the controller 110 is operatively connected to only one or the other of the exhaust system 140 and the engine 160. In some embodiments where the controller 110 controls the engine 160, the startup characteristics previously described include a startup RPM for the engine 160, as well as an idle RPM for controlling the engine 160 within the idle characteristics. In an exemplary embodiment, the startup RPM is higher for the first operating mode 121*a* than for a second operating mode 121*b*. Other exemplary startup RPM and idle RPM values are provided in FIG. 9, which as demonstrated are based off of a set standard (std.). In some embodiments, the standard corresponds to the conventional controls for operating a conventional marine propulsion system. The depiction of relative RPM values is for the purpose of demonstration only, whereas these values may also be fixed.

In addition to the controller 110 being operatively connected to the engine 160, the same or other functions of the engine 160 may be controlled by a separate engine control unit (ECU) 170. In such a configuration and in certain embodiments, the engine control units 170 may override the controller 110 in controlling one or more functions of the engine 160 during operation. For example, despite a selected operating mode corresponding to controlling the engine 160 to produce a quieter sound output 180, the engine control unit 170 may override control of the engine 160 to nonetheless perform in a manner that produces a louder sound output 180. In certain embodiments, this override of the controller 110 by the engine control unit 170 occurs when the throttle position 161*b* is in a particular orientation (such as full open), when the engine 160 is struggling to run at idle speed, or in other circumstances as required for safe and efficient operation and a positive user experience. Control by the controller 110 may also be deactivated entirely when other features of the marine vessel are active, such as a station-keeping or automatic docking functions, for example. A separate feedback loop is optionally provided between the engine control unit 170 and the controller 110 directly. For example, such a feedback loop may be incorporated into a CAN Kingdom network as disclosed in U.S. Pat. No. 6,273,771.

While not expressly shown, the engine control unit 170 (or another control unit) may also or alternatively be connected to the exhaust system 140, which is discussed further below. Such an arrangement may again override the controller 110 in certain embodiments and in certain operating modes 121*a-x*.

FIG. 8B depicts another exemplarily configuration of a marine propulsion system 100 according to the present disclosure, this time including a bypass valve 150 connected to the exhaust system 140. In addition to the controller 110 controlling functions also found in conventional exhaust systems 140, the controller 110 further controls a bypass valve position 124 of the bypass valve 150 in accordance with the selected one of the operating modes 121*a-x*. These bypass valve positions 124 include the bypass valve 150 being in an open, closed, or intermediate position. It should be recognized that while the present disclosure generally refers to the bypass valve position 124 being "intermediate" without further specificity, this includes any position of the bypass valve 150 between the closed position (0% open) and the open position (100% open). In accordance with the selected one of the operating modes 121*a-x*, the controller 110 causes the bypass valve 150 to be positioned per the bypass valve position 124 associated with the selected one of the operating modes 121*a-x*. This bypass valve position 124 is thus another function or variable in which the controller 110 can control the marine propulsion system 100 to actively tune the sound output 180 produced during its operation.

As discussed above, FIG. 9 depicts some exemplary operating modes 121*a-x* for the controller 110 to control the marine propulsion system 100. The examples in FIG. 9 are non-limiting and demonstrate different controls of a bypass valve position 124, the engine RPM 161*a*, and the fuel/air blend 161*d* at multiple exemplary states of operation: at startup, X seconds post-startup, Y seconds post-startup, at idle speed, at Z % throttle, and at wide open throttle. For example, in accordance with certain embodiments, operating mode 121*a* corresponds to a bypass valve position 124 that is open through all of the previously-listed states, the engine RPM 161*a* at startup is a standard (std.) RPM level plus 40% (in other words, if a normal startup RPM is 1000 RPM, standard plus 40% would be 1400 RPM), and with a "rich" fuel/air blend 161*d* (meaning more fuel is provided relative to air than a standard ratio). It should be recognized that while the present disclosure simply refers to this fuel/air blend 161*d* as "rich," this merely exemplifies combinations of controls provided by the controller 110. Other ratios of fuel/air blend, and at any of state of operation, are also anticipated by the present disclosure.

For comparison, operating mode 121*b* is depicted in FIG. 9 as corresponding to the controller 110 controlling the bypass valve position 124 to be closed at all states of operation, to have a standard engine RPM 161*a*, and standard fuel/air blend 161*d*. Likewise, operating mode 121*m* corresponds to controlling the marine propulsion system 100 to operate similar to that of one having no bypass valve 150, since the bypass valve position 124 is always closed. Finally, operating mode 121*p* provides for the controller 110 to control the bypass valve position 124 to be in an intermediate position during all states of operation, along with having a standard engine RPM 161*a* and varying fuel/air blend 161*d* ratios depending on the state of operation.

It should be recognized that in addition to the exemplary combinations of controls provided as operating modes 121*a-r* in FIG. 9, further operating modes are also anticipated by the present disclosure. Likewise, additional aspects of performance by one or both of the engine 160 and the exhaust system 140 are anticipated, such as the level or timing of spark 161*c* delivered by spark plugs, active noise cancellation operations, and other features of the engine 160, exhaust system 140, or other components within the marine propulsion device 100.

It should further be noted that, in use, a marine propulsion system 100 may be equipped with any number of selectable operating modes. For example, some embodiments of marine propulsion system 100 have a first operating mode colloquially referred to as a "sport" or "aggressive" mode in which the sound output 180 generated by the marine propulsion system 100 is louder, or sustained at a louder volume for longer duration of time at startup or other states of operation relative to a standard marine propulsion system. The "standard" marine propulsion device 100 referenced may be a conventional marine propulsion system that does not provide active tuning of sound. Alternatively, the "standard" may simply be one of the operating modes 121*a-x* according to the present disclosure that is designated as such. Likewise, a selectable second operating mode in such embodiments may either cause the marine propulsion system 100 to operate and generate a sound output 180 in a conventional or standard manner, or in a "quiet" mode in which a lower volume of sound output 180 is generated by the marine propulsion system 100, and/or to transition to a quieter volume faster.

In certain embodiments, the operating modes 121*a-x* further include different transitions between the startup characteristics and the idle characteristics previously described, whereby each transition defines control by the controller 110 between the engine 160 starting and the engine 160 operating at the idle speed. In this regard, the transition for a first operating mode 121*a* is different than for a second operating mode 121*b* such that different sound output 180 is generated by the marine propulsion system 100 during that period. In certain embodiments, the transitions of operation modes 121*a-x* may include different durations of time between the engine 160 starting and the engine 160 being controlled at idle speed. For example, the time for the transition may be longer for the first operating mode 121*a* than for the second operating mode 121*b*.

Figure 10:
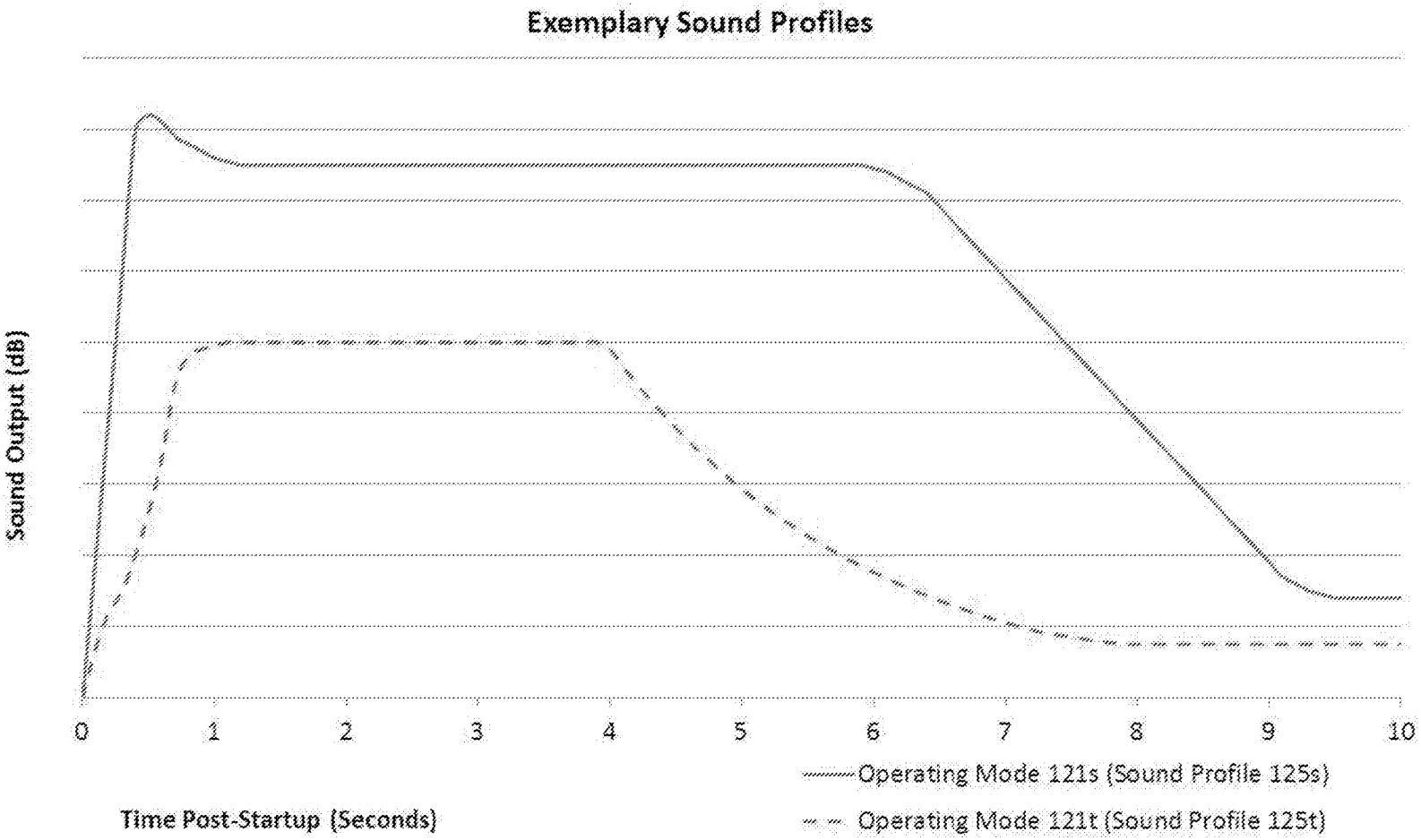
FIGS. 10-11 depict exemplary sound profiles of the sound output generated by the marine propulsion systems when controlled per the operating modes according to the present disclosure.
Figure 11:
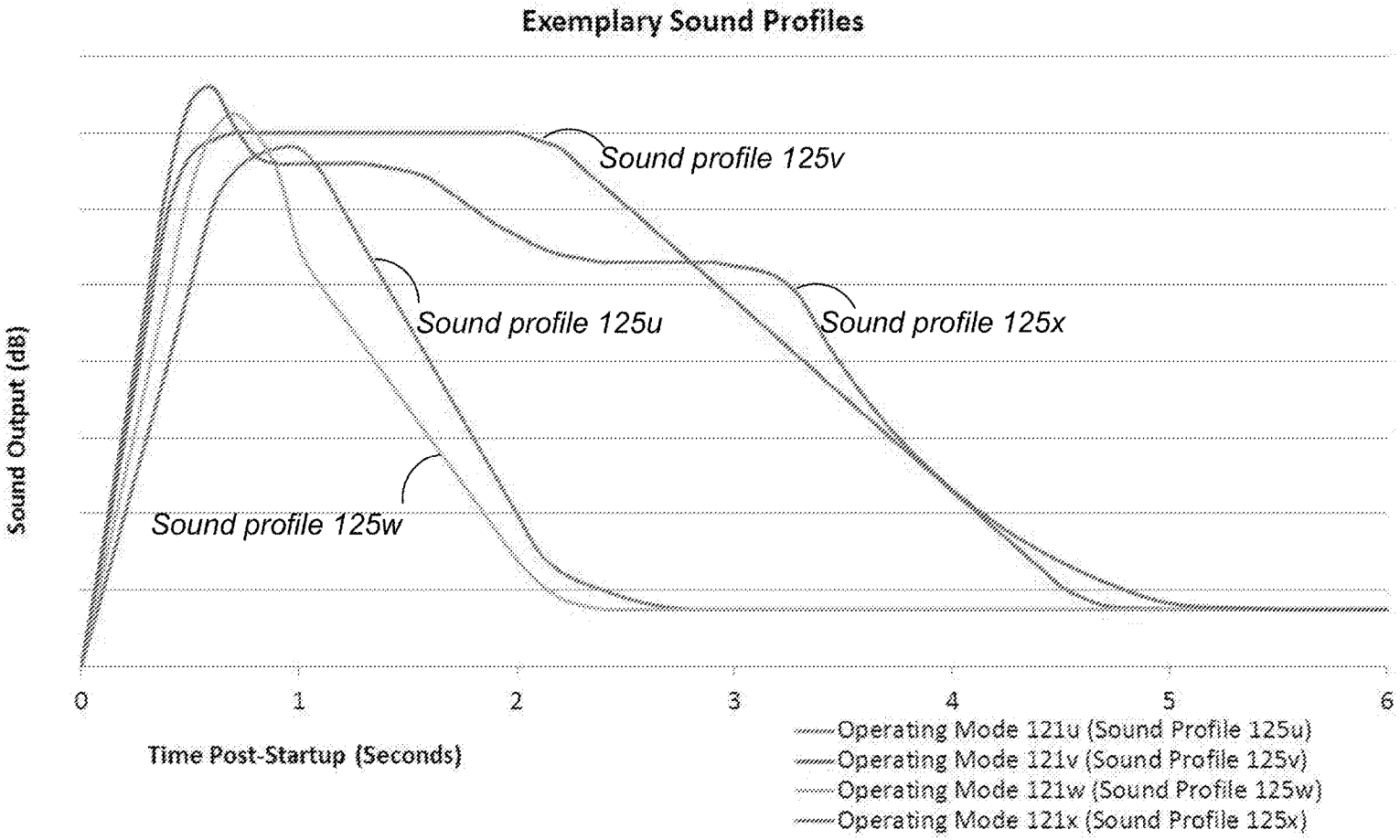

FIGS. 10 and 11 depict exemplary sound profiles 125*s-t* for the marine propulsion system 100 between the engine 160 starting at time 0 and the engine 160 being controlled at idle speed. Exemplary idle speeds are shown to occur approximately 9.5 seconds and 7.5 seconds after startup for sound profiles 125*s* and 125*t*, respectively. FIG. 10 further depicts sound profile 125*s* (which corresponds to operating mode 121*s*) having a greater sound output 180 at startup (shown substantially near 1 second) than sound profile 125*t* at the same time. Likewise, sound profile 125*s* is shown to have a longer transition time than sound profile 125*t*, based on the respective times between startup and idle speed as discussed above.

FIG. 11 depicts additional exemplary sound profiles 125*u-x* for the sound output 180 generated by the marine propulsion system 100 when controlled according to the operating modes 121*a-x*. In addition to sound profiles 125*u-x* corresponding to different amplitudes of sound output 180, sound profiles 126*u-x* also provide different patterns or characteristics of transitions between startup and the engine 160 being controlled at idle speed. For example, the transition of sound profile 125*v* has a long-sustained plateau, sound profile 125*x* has multiple plateaus, and sound profiles 125*u* and 125*w* have transitions that more closely follow a statistical normal curve. Moreover, in certain embodiments, the transition within a sound profile 125*a-x* includes an exponential decay (sound profile 125*x*), whereas others have substantially-linear transitions between the loudest sound output 180 and the sound output 180 at idle speed (sound profile 125*v*). The foregoing merely demonstrates a few differences between sound profiles 125*u-x*, though one of ordinary skill in the art will identify countless others in FIG. 12. Likewise, other patterns and characteristics are also anticipated by the present disclosure.

As previously described, certain embodiments of the present disclosure provide that the controller 110 controls the marine propulsion system 100 to produce different sound outputs 180 by controlling engine 160 parameters, including engine RPM 161*a* and fuel/air blend 161*d*. However, certain embodiments also or alternatively provide that the controller 110 to change or tune the sound output 180 by controlling the exhaust system 140 (such as the exhaust system 10 previously described with respect to FIGS. 1-3).

As shown in FIGS. 2 and 3, certain embodiments of the present disclosure relate to an exhaust system 10 having an idle relief outlet 24 located above the body of water at least when the engine (not shown) is controlled at an idle speed. In such configurations, the exhaust system 140 is configured to discharge the exhaust gas from the engine to atmosphere via the idle relief outlet 24, and also configured to discharge the exhaust gas to the body of water via the propeller housing outlet 19. Some embodiments further include a bypass valve 26, as shown in FIGS. 2 and 3. As discussed above, the bypass valve 26 is positionable in an open position wherein the exhaust gas is permitted to flow to atmosphere via the idle relief outlet 24, and in a closed position such that the idle gas is permitted to flow to the atmosphere through the idle relief outlet 24.

In accordance with the present disclosure, the controller 110 (FIGS. 8A-B) in certain embodiments is configured to actively tune the sound output 180 generated by the marine propulsion system 100 through control of the bypass valve 26. In other words, the controller 110 selectively permits exhaust gas to discharge to atmosphere via the idle relief outlet 24 on command. This is in contrast to marine propulsion systems in the art, whereby bypass valves are passively actuated based only on the pressure differential between discharging through the idle relief muffler E and idle relief outlet F, and overcoming the pressure of the body of water acting on the underwater outlet D (see FIG. 1). Discharging to atmosphere through the idle relief outlet 24 according to the present disclosure produces a different sound output 180 than discharging into the body of water, as would be recognized by one having ordinary skill in the art. For example, opening the bypass valve 26 to discharge through the idle relief outlet 24 while underway (i.e., not at idle) would produce a louder sound output 180 than discharging into the body of water. In this manner, the controller 110, through input from the input device 102, controls the bypass valve 26 of the marine propulsion system 100 to produce and actively tune the desired sound output 180.

In further embodiments, such as those shown in FIGS. 4-5, the exhaust system 50 includes a primary muffler 62 and a secondary muffler 64. The bypass valve 74 in the open position permits exhaust gas to bypass the secondary muffler 64 to flow from the primary muffler 62 to the idle relief outlet 72. In contrast, when the bypass valve 74 is in the closed position, the exhaust gas is not permitted to bypass the secondary muffler 64 and instead flows from the primary muffler 62 to the idle relief outlet 72 via the secondary muffler 64.

In accordance with the present disclosure, a controller 110 can be coupled to systems such as those shown in FIGS. 4-5 to permit an operator to actively tune the sound output 180 generated by the marine propulsion system 100. Specifically, the controller 110 controls the whether the exhaust gas exits through both the primary muffler 62 and the secondary muffler 64, or through only the primary muffler 62, depending upon the selection of operating modes 121*a-x*. In certain embodiments, the path for exhaust to exit is constant for some operating modes 121*a-x*, while changing depending on the state of operation (i.e., startup, idle speed, or a particular throttle position) for other operating modes 121*a-x*. It should also be recognized that bypass valve 74 may be positioned in intermediate positions whereby some, but not all, exhaust gas is directed to the secondary muffler 64 in certain embodiments and in certain operating modes 121*a-x*.

In other embodiments, multiple bypass valves 74 are incorporated within the exhaust system 140 such that the controller 110 can select whether the exhaust gas also bypasses the primary muffler 62. In some embodiments, this causes the exhaust gas to be discharged straight from the engine to the idle relief outlet 72 in certain operating modes 121*a-x*, via the primary muffler 62 in certain other operating modes 121*a-x*, and/or through both the primary muffler 62 and the secondary muffler 64 in further operating modes 121*a-x*.

The present disclosure also provides for methods of making a marine propulsion system 100 configured to propel a marine vessel in a body of water. Similarly to the systems previously described, these methods include coupling an exhaust system 140 to an engine 160, where the exhaust system 140 conveys exhaust gas from the engine 160. A controller 110 is operatively connected to the marine propulsion system 100 such that the controller 110 controls the marine propulsion system 100. The controller 110 also includes a memory module 120 that stores operating modes 121*a-x* and corresponding sound profiles 125*a-x* for controlling the marine propulsion device 100. The controller 110 is also operatively connected to input device 102 configured for selecting one of the operating modes 121*a-x* for controlling the marine propulsion system 100.

In this manner, selecting a first operating mode 121*a* causes the marine propulsion system 100 to sound different, or to generate a different sound output 180, than when selecting a second operating mode 121*b*. In certain embodiments, the operating modes 121*a-x* include startup characteristics for controlling the marine propulsion system 100 when the engine 160 starts, and idle characteristics for controlling the marine propulsion system 100 when controlling the engine 160 at an idle speed such that at least one of the startup characteristics and the idle characteristics is different for the first operating mode 121*a* than for the second operating mode 121*b*.

In certain embodiments, the startup characteristics include a startup RPM for controlling the engine 160 and the idle characteristics include an idle RPM for controlling the engine 160, where at least the startup RPM is higher for the first operating mode 121*a* than for the second operating mode 121*b*. Furthermore, in certain embodiments, the operating modes 121*a-x* include a transition between the startup characteristics and the idle characteristics for each of the operating modes 121*a-x*. The transition defines control of the marine propulsion device 100 between the engine 160 starting and the engine 160 operating at the idle speed, and the transition for the first operating mode 121*a* is different that for the second operating mode 121*b*.

Certain embodiments of the present disclosure also include an idle relief outlet 24 that operates in conjunction with the exhaust system 140. As previously discussed, the idle relief outlet 24 is located above the body of water when the engine 160 is controlled at the idle speed. Furthermore, certain embodiments include a bypass valve 26 that is coupled within the exhaust system 140, where the bypass valve 26 is positionable in an open position whereby the exhaust gas is permitted to discharge to atmosphere via the idle relief outlets 24 and also positionable in a closed position wherein the exhaust gas is not permitted to discharge to the atmosphere via the idle relief outlet 24. In such embodiments, the bypass valve 26 is positioned based at least in part on which of the operating modes 121*a-x* is selected.

Further embodiments include the step of coupling a primary muffler 62 and a secondary muffler 64 within the exhaust system 140. In certain embodiments, when the bypass valve 74 is in the open position, the exhaust gas is permitted to bypass the secondary muffler 64 and to discharge from the primary muffler 62 to the idle relief outlet 72. In contrast, when the bypass valve 74 is in the closed position, the exhaust gas is not permitted to bypass the secondary muffler 64 and instead discharges from the primary muffler 62 to the idle relief outlet 72 via the secondary muffler 64.

In certain embodiments, the controller 110 positions the bypass valve 150, and also controls the engine 160, such that selecting the first operating mode 121*a* causes the marine propulsion system 100 to be louder than selecting a second operating mode 121*b*.

Yet another embodiment of the present disclosure relates to a marine propulsion device 100 for propelling a marine vessel in a body of water. The marine propulsion device 100 includes an engine 160 and an engine exhaust system 140 that conveys exhaust gas from the engine 160. A controller 110 controls the marine propulsion device 100 according to alternate first and second operational modes 121*a-b* stored in a memory module 120 within the controller 110. It should be recognized that the memory module 120 may be incorporated within the controller 110, or may be a separate device in commination with the controller 110. The marine propulsion device 100 is controllable to perform a same set of functions in either of the first and second operational modes 121*a-b*, wherein the first and second operational modes 121*a-b* cause the marine propulsion device 100 to produce first and second sound profiles in generating a sound output 180, which are different from each other. An operator input device (shown as input device 102) facilitates operator selection between first and second operational modes 121*a-b* to thereby produce the selected one of the first and second sound profiles.

Through experimentation and development, the present inventors have identified that in devices known in the art only provide for changes to sound output by changing the path of exhaust gas conveyed from the engine. Even in devices offering a "sport mode" and "quiet mode", these modes merely correspond to a physical change to the exhaust system (such as opening or closing a bypass valve). Regardless of the configuration chosen, a same, common "base" operating mode and sound profile (also referred to as a calibration map) is used to control the device. In other words, the devices known in the art are controlled according to a single calibration map for the particular device.

As such, the present inventors have identified that devices known in the art devices do not provide for control to select or actively tune of the sound output produced. Instead, changes in sound output are limited only to the selection of valve position for the bypass valve.

Moreover, the present inventors have identified that because devices are controlled using the same operating mode or calibration map regardless of changes to the exhaust system circuit (i.e., regardless of bypass valves being opened or closed), performance and sound output are not optimized for each given configuration. Furthermore, controlling the devices with only a single calibration map causes the controller to counteract or work against physical changes to the exhaust system in an attempt to achieve the same target values. For example, if the calibration map targets a particular RPM at idle speed, then even if the position of a bypass valve would otherwise cause that RPM to be higher or lower, the controller will negate the impact of the bypass valve change to "correct" the resultant RPM.

The present inventors have identified the presently disclosed solutions for leveraging the selection of operating modes (with corresponding sound profiles) to accentuate hardware differentiations. In this regard, the presently disclosed systems and methods provide for active tuning of the sound output generated by a marine propulsion system that also accounts for hardware configuration.

Through this optimization, the present inventors have also identified that additional sound quality benefits can be achieved beyond what can be provided through hardware changes. In other words, the presently disclosed systems and methods allow differences in sound output provided by changes in engine and exhaust system performance to be accentuated or minimized at the operator's discretion. Moreover, leveraging the different operating modes also provides for actively tuning the sound output of a marine propulsion device that does not have an active idle relief system, or a bypass valve, which is not presently possible with device known in the art.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A marine propulsion system configured to propel a marine vessel in a body of water, the marine propulsion system comprising:

an engine;

an exhaust system that conveys exhaust gas from the engine;

a controller that controls the marine propulsion system, wherein the controller comprises a memory module that stores operating modes with corresponding sound profiles for controlling the marine propulsion system; and an input device for selecting one of the operating modes for controlling the marine propulsion system, wherein selecting a first operating mode causes the marine propulsion system to sound different than selecting a second operating mode with respect to at least one of amplitude, frequency, duration at a given amplitude or frequency, and pattern thereof;

wherein the exhaust system comprises an idle relief outlet located above the body of water at least when the engine is controlled at an idle speed, wherein the exhaust system is configured to discharge the exhaust gas to atmosphere via the idle relief outlet, and wherein the exhaust system is also configured to discharge the exhaust gas to the body of water.

2. The marine propulsion system according to claim 1, wherein the operating modes include startup characteristics for controlling the marine propulsion system when the engine starts and idle characteristics for controlling the marine propulsion system when the engine is controlled at an idle speed, wherein at least one of the startup characteristics and the idle characteristics is different for the first operating mode than for the second operating mode.

3. The marine propulsion system according to claim 2, wherein the startup characteristics include a startup RPM for controlling the engine and the idle characteristics include an idle RPM for controlling the engine, and wherein the startup RPM is higher for the first operating mode than for the second operating mode.

4. The marine propulsion system according to claim 2, wherein the operating modes further include a transition between the startup characteristics and the idle characteristics for each of the operating modes, wherein between the engine starting and the engine operating at the idle speed the transition defines control of the marine propulsion system, and wherein the transition for the first operating mode is different than for the second operating mode.

5. The marine propulsion system according to claim 4, wherein the transitions each include a time between the engine starting and the engine is controlled at the idle speed, and wherein the time is longer for the first operating mode than for the second operating mode.

6. The marine propulsion system according to claim 5, wherein the startup characteristics include a startup RPM for controlling the engine and the idle characteristics include an idle RPM for controlling the engine, and wherein the transition for the first operating mode includes an exponential decay from the startup RPM to the idle RPM.

7. The marine propulsion system according to claim 1, wherein the operating modes each include a fuel to air ratio for controlling the engine, and wherein the fuel to air ratio for the first operating mode is different than for the second operating mode.

8. The marine propulsion system according to claim 1, further comprising a bypass valve that is positionable into an open position wherein the exhaust gas is permitted to flow to atmosphere via the idle relief outlet and into a closed position wherein the exhaust gas is not permitted to flow to the atmosphere via the idle relief outlet, wherein the bypass valve is positioned based at least in part on which of the operating modes is selected.

9. The marine propulsion system according to claim 8, further comprising a primary muffler and a secondary muffler, wherein when the bypass valve is in the open position the exhaust gas is permitted to bypass the secondary muffler and flow from the primary muffler to the idle relief outlet and when the bypass valve is in the closed position the exhaust gas is not permitted to bypass the secondary muffler and instead flows from the primary muffler to the idle relief outlet via the secondary muffler.

10. The marine propulsion system according to claim 9, wherein the bypass valve is further positionable in an intermediate position in which some but not all of the exhaust gas is permitted to flow to the idle relief outlet.

11. The marine propulsion system according to claim 10, wherein a user input is receivable in the input device for selecting one of the operating modes, further comprising an engine control unit configured to override the user input for selecting one of the operating modes when alternative operating characteristics so require.

12. A method of making a marine propulsion system configured to propel a marine vessel in a body of water, the method comprising:

coupling an exhaust system to an engine, wherein the exhaust system conveys exhaust gas from the engine;

operatively connecting a controller to the marine propulsion system, the controller controlling the marine propulsion device and also comprising a memory module;

storing in the memory module operating modes with corresponding sound profiles for controlling the marine propulsion system; and operatively connecting to the controller an input device configured for selecting one of the operating modes for controlling the marine propulsion system;

wherein selecting a first operating mode causes the marine propulsion system to sound different than selecting a second operating mode with respect to at least one of amplitude, frequency, duration at a given amplitude or frequency, and pattern thereof, the exhaust system comprising an idle relief outlet located above the body of water when the engine is controlled at the idle speed, further comprising coupling a bypass valve within the exhaust system, the bypass valve being positionable in an open position wherein the exhaust gas is permitted to discharge to atmosphere via the idle relief outlet and also positionable in a closed position wherein the exhaust gas is not permitted to discharge to the atmosphere via the idle relief outlet, wherein the bypass valve is positioned based at least in part on which one of the operating modes is selected.

13. The method according to claim 12, wherein the operating modes include startup characteristics for controlling the marine propulsion system when the engine starts and idle characteristics for controlling the marine propulsion system when controlling the engine at an idle speed, wherein at least one of the startup characteristics and the idle characteristics is different for the first operating mode than for the second operating mode.

14. The method according to claim 13, wherein the startup characteristics include a startup RPM for controlling the engine and the idle characteristics include an idle RPM for controlling the engine, wherein the startup RPM is higher for the first operating mode than for the second operating mode.

15. The method according to claim 13, wherein the operating modes further include a transition between the startup characteristics and the idle characteristics for each of the operating modes, wherein between the engine starting and the engine operating at the idle speed the transition defines control of the marine propulsion system, and wherein the transition for the first operating mode is different than for the second operating mode.

16. The method according to claim 12, further comprising coupling both a primary muffler and a secondary muffler within the exhaust system such that when the bypass valve is in the open position the exhaust gas is permitted to bypass the secondary muffler and discharge from the primary muffler to the idle relief outlet and when the bypass valve is in the closed position the exhaust gas is not permitted to bypass the secondary muffler and instead discharges from the primary muffler to the idle relief outlet via the secondary muffler.

17. The method according to claim 12, wherein the controller positions the bypass valve and also controls the engine such that selecting the first operating mode causes the marine propulsion system to be louder than selecting a second operating mode.

* * * * *